US008284071B2

(12) United States Patent
Peng et al.

(10) Patent No.: US 8,284,071 B2
(45) Date of Patent: Oct. 9, 2012

(54) DOOR ASSEMBLY INCLUDING A TOUCH SENSITIVE PORTION FOR CONTROLLING AUTOMATED DOOR MOVEMENT

(75) Inventors: Pei-Yuan Peng, Ellington, CT (US); Jaime A. Rivera, Bristol, CT (US); Atsushi Yamada, Narita (JP); Takashi Saiki, Chiba (JP)

(73) Assignee: Otis Elevator Company, Farmington, CT (US)

( * ) Notice: Subject to any disclaimer, the term of this patent is extended or adjusted under 35 U.S.C. 154(b) by 692 days.

(21) Appl. No.: 12/092,155

(22) PCT Filed: Sep. 12, 2006

(86) PCT No.: PCT/US2006/035495

§ 371 (c)(1), (2), (4) Date: Sep. 17, 2009

(87) PCT Pub. No.: WO2007/058697

PCT Pub. Date: May 24, 2007

(65) Prior Publication Data

US 2010/0019919 A1 Jan. 28, 2010

(30) Foreign Application Priority Data

Nov. 16, 2005 (JP) ..... 2005-331121

(51) Int. Cl.
*G08B 21/00* (2006.01)

(52) U.S. Cl. ..... 340/686.6; 340/686.1; 340/665; 340/668; 340/556; 340/557; 49/169; 49/360; 49/506

(58) Field of Classification Search ..... 340/686.6, 340/686.1, 665, 668, 556, 557; 49/169, 360, 49/506

See application file for complete search history.

(56) References Cited

U.S. PATENT DOCUMENTS 3,370,677 A 2/1968 Federmann et al.

(Continued)

FOREIGN PATENT DOCUMENTS

JP 7149489 A 6/1995

(Continued)

OTHER PUBLICATIONS

International Search Report and Written Opinion of the International Searching Authority for International Application No. PCT/US2006/035495 mailed Feb. 13, 2007.

(Continued)

*Primary Examiner* — Tai T Nguyen
(74) *Attorney, Agent, or Firm* — Carlson, Gaskey & Olds PC

(57) ABSTRACT

An assembly (20) for controlling movement of an automatically moveable door panel (22) includes a sensor (30, 32, 34) positioned on at least one of a door panel (22) or a door frame member (24, 26). The sensitive portion provides an indication of when an object is in contact with or in very close proximity to a sensitive portion. A sensitive portion is established over an area of the door or door frame member at which an object may become caught during automated door movement. A disclosed example includes using an electromechanical film as a sensor so that the sensitive portion is responsive to pressure applied by the object on the sensitive portion. Another disclosed example includes a field effect sensor that generates an electric field that is at least partially interrupted when an object contacts or comes in very close proximity to the sensitive portion. Automated movement of a door is controlled responsive to an indication of the presence of an object in a location where the object may become caught during automatic movement of the door.

20 Claims, 5 Drawing Sheets

U.S. PATENT DOCUMENTS

| | | | | |
|---|---|---|---|---|
| 5,075,632 | A | 12/1991 | Payne et al. | |
| 5,996,281 | A * | 12/1999 | Takano et al. | 49/26 |
| 6,080,981 | A * | 6/2000 | Payne | 250/221 |
| 6,873,863 | B2 | 3/2005 | Hitunen | |
| 6,989,767 | B2 * | 1/2006 | Fitzgibbon et al. | 340/908.1 |
| 7,165,457 | B2 * | 1/2007 | Ogino et al. | 73/700 |
| 7,373,756 | B2 * | 5/2008 | Okulov et al. | 49/346 |

FOREIGN PATENT DOCUMENTS

| | | |
|---|---|---|
| JP | 07242383 | 9/1995 |
| JP | 09077440 | 3/1997 |
| JP | 2001089054 | 4/2001 |
| JP | 2002265175 | 9/2002 |
| JP | 2003026382 | 1/2003 |
| JP | 2004018261 | 1/2004 |
| WO | 0196225 A1 | 12/2001 |
| WO | 0230803 A1 | 4/2002 |

OTHER PUBLICATIONS

International Preliminary Report on Patentability for International application No. PCT/US2006/035495 mailed Feb. 6, 2008.

* cited by examiner

DOOR ASSEMBLY INCLUDING A TOUCH SENSITIVE PORTION FOR CONTROLLING AUTOMATED DOOR MOVEMENT

FIELD OF THE INVENTION

This invention generally relates to automatically moving doors. More particularly, this invention relates to controlling movement of an automatically moveable door.

DESCRIPTION OF THE RELATED ART

There are various automated door arrangements used in various contexts. In some instances, the automated door slides in a direction parallel to the door panel between open and closed positions. This type of arrangement is commonly used for providing access to an elevator car.

Whenever an automated door moves toward a position where an edge of the door approaches another structural member in a closed position, it is possible for an object to get caught between the door and the other structural member. Various arrangements have been proposed to avoid such a situation.

In the case of elevator doors, it has been known to use a safety shoe that mechanically detects an obstacle near a closed position of a door by including a bar at the leading edge of the door. If an obstacle contacts the bar, that provides an indication that the door should not be fully closed automatically to allow for the obstacle to be removed so that it will not be caught between the door and another surface. Another example approach has been to use light-based detectors that generate a sensing light beam across an opening. If an obstacle is within the opening while a door is automatically closing and interrupts the light beam, the door will not be fully closed automatically to avoid the object being caught by the door.

There are limitations to such devices. For example, the safety shoe bar typically is not sensitive enough to detect relatively small objects such as a strap on a handbag or an individual finger. Additionally, such small objects may get caught if they are not located at the same position as the bar of the safety shoe. The light-based detectors are also limited in that an object may not be within the field of vision (e.g., the light beam) even though the object is in a position where it can be caught by the door. Another drawback to known light-based arrangements is that they are typically exposed to dust or debris that can interfere with proper operation. Another potential issue is presented if other light sources interfere with the detectors.

Another shortcoming of such devices is that they only address the possibility of an object being caught at the leading edge of the door as it moves toward a closed position.

It would be desirable to provide an improved arrangement for detecting when an object may be in a position to be caught by a door that is automatically moving. It would be beneficial to provide an arrangement that can detect the potential for an object being caught when a door is automatically moving toward a closed position, toward an open position or both. This invention addresses those needs.

SUMMARY OF THE INVENTION

An exemplary door assembly includes a door panel that is automatically moveable relative to a door frame between open and closed positions. A sensor is supported on at least one of the door frame or the door panel for establishing a sensitive portion on the door frame or door panel. The sensor detects an object within a proximity of the sensitive portion and provides an output indicative of the detected object. A controller controls automatic movement of the door panel responsive to the sensor output.

In one example, the sensor detects the object responsive to pressure applied by the object on the sensitive portion. In one example, the sensor comprises an electromechanical film (EMFi).

In another example, the sensor generates an electric field and detects when the object is close enough to the sensitive portion to at least partially interrupt the electric field. In one example, the object need not actually contact the sensitive portion to interrupt the electric field sufficiently to cause the sensor to provide the output indicating the presence of the detected object. In one example, the sensor detects when the object touches the sensitive portion and, therefore, at least partially interrupts the electric field.

An assembly designed according to this invention allows for more comprehensive detecting capabilities useful for controlling movement of an automatically moveable door regardless of the direction of movement. By strategically positioning a sensor to establish a sensitive portion, a variety of potential object-catching scenarios can be protected against.

The various features and advantages of this invention will become apparent to those skilled in the art from the following detailed description. The drawings that accompany the detailed description can be briefly described as follows.

DETAILED DESCRIPTION OF THE PREFERRED EMBODIMENT

Disclosed examples include a sensitive portion on at least one of a door panel or a door frame that allow for detecting when an object is in a position relative to the door panel or door frame where the object may be caught during automatic movement of the door panel relative to the frame. Disclosed examples provide for detecting such situations whether the door is automatically moving toward an open or a closed position. With the example approach, a wider variety of objects may be reliably detected and a larger number of scenarios within which an object may be caught during automatic door movement can be addressed.

Figure 1:
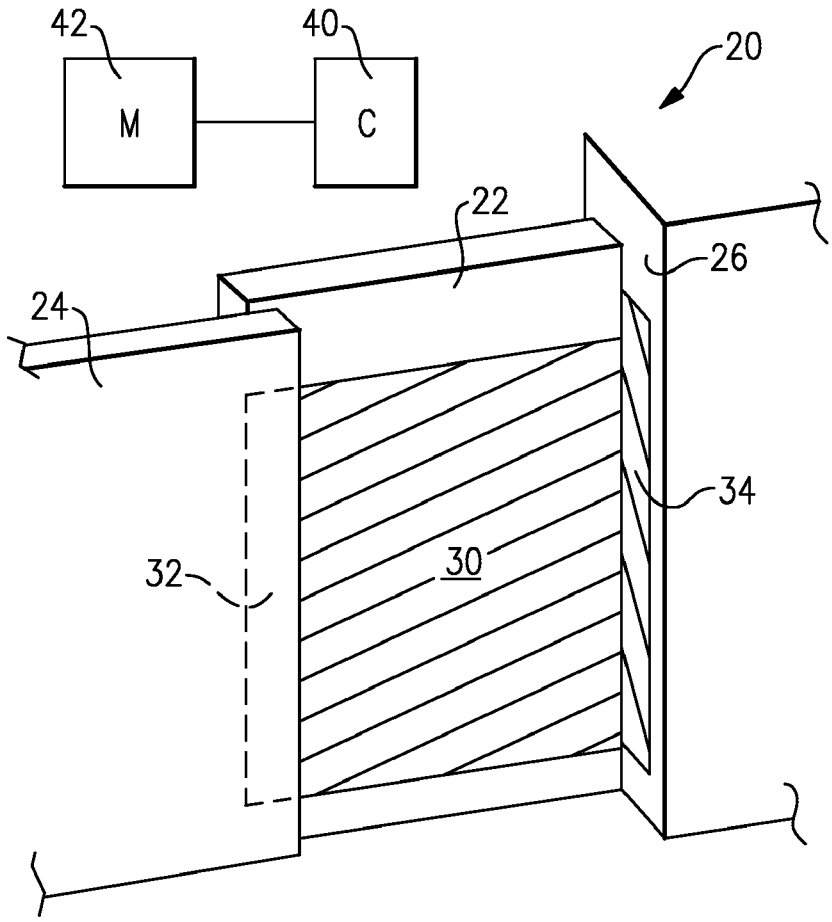
FIG. 1 schematically illustrates an example door assembly including features designed according to an embodiment of this invention.

FIG. 1 schematically shows selected portions of an example door assembly 20. A door panel 22 is automatically moveable between open and closed positions. The example of FIG. 1 shows a door panel 22 in a closed position. In the illustrated example, the door panel 22 moves relative to a return panel 24, as the door panel 22 moves between the open and closed positions. The return panel 24 is part of the door frame in this example and is adjacent a pocket for receiving the door panel 22 in the open position.

In the fully closed position shown in FIG. 1, a leading edge of the door panel 22 is immediately adjacent a door frame member 26. In this example, the door panel 22 effectively moves across the entire opening between an open and fully closed position. In another example, a set of doors are provided where the leading edges of the doors move in opposite directions toward each other so that two doors meet adjacent each other near a center of the opening. As will be appreciated by those skilled in the art who have the benefit of this description, this invention is useful for a variety of door assembly configurations. Given this description, those skilled in the art will realize how to implement the features of this invention to meet their particular needs.

The door panel 22 has an associated sensor 30 that establishes a sensitive portion on the door panel 22. In the illustrated example, the sensor 30 has a physical dimension that corresponds to the dimension of the sensitive portion. The sensor 30 is able to detect when an object, such as an individual's hand, for example, is touching or very near the sensitive portion. In the illustrated example, the sensor 30 is mounted on a selected side of the door panel 30 so that the sensitive portion is established in a desired orientation.

In one example, the sensor 30 comprises an electromechanical film (EMFi) that generates an output voltage responsive to pressure applied to the film. Such pressure will result from an individual leaning their hand or another object against the sensitive portion of the door panel 22, for example.

In another example, the sensor 30 is a field effect sensor that generates an electrical field along the sensitive portion of the door panel 22. In such an example, the sensor 30 is capable of detecting contact between an object and the sensitive portion. As the object at least partially interrupts the electrical field of the sensor 30, the sensor 30 provides an output indicating that (e.g., detection of the object). The electrical field may be interrupted by direct contact between the object and the sensitive portion of the door panel 22. In another example, the sensor 30 is capable of detecting when an object is very near to, but not quite contacting, the sensitive portion provided that the object is close enough to at least partially interrupt the electric field of the sensor 30.

One advantage of the example of FIG. 1 is that the sensor 30 can establish a sensitive portion across a significant area on the door panel 22. Such an arrangement allows for detecting when an object is in a variety of locations, each of which may render the object subject to being caught during automated movement of the door panel 22. For example, the illustrated sensitive portion associated with the sensor 30 can detect when an object is near a leading edge of the door panel 22 where it may be caught between the panel 22 and the door frame 26 as the door moves toward a closed position. Additionally, whenever an object is on or very near the sensitive portion of the door panel 22 during an opening movement, it may be possible for the object to be caught between the door panel 22 and the return panel 24 as the door retracts into an open position. The sensitive portion established by the sensor 30 allows for detecting such an object at any point along the path of movement toward the open position. Accordingly, the disclosed example allows for a greater range of detecting objects in a wider variety of positions where the object may potentially be caught during automated door movement.

Additionally, the disclosed example is capable of detecting very small objects that were not noticeable by previous sensor arrangements.

The example of FIG. 1 includes another sensor 32 on the return panel 24. The sensor 32 establishes a sensitive portion on the return panel 24 that is essentially coextensive with a size of the sensor 32. In this example, the sensor 32 is near the interface between the door panel 22 and the return panel 24 near edge of the return panel 24 for detecting when an object may potentially get caught between the door panel 22 and the return panel 24. The sensor 32 may be pressure activated, touch activated or of the type that detects an object in very close proximity to the sensitive portion like the sensor 30 described above.

The example of FIG. 1 includes another sensor 34 establishing a sensitive portion on the door frame member 26. The sensor 34 operates in the same manner as the sensors 30 and 32. It may be advantageous to provide a plurality of sensors as shown in FIG. 1 or only a selected one or more of them may be used, depending on the needs of a particular situation. Given this description, those skilled in the art will realize how best to arrange sensors and corresponding sensitive portions to meet their particular needs.

The example of FIG. 1 includes a controller 40 that controls operation of an automated door mover 42. The sensors 30, 32 and 34 provide an output indicating when an object has been detected in a corresponding sensitive portion. That output is provided to the controller 40, which responsively controls automatic movement of the door panel 22.

In one example, whenever an object is detected at a sensitive portion, the controller 40 determines whether the automated mover 42 is currently moving the door panel 22. If the door is stationary, the controller 40 responds to the sensor output by providing an indication that an object should be moved away from the door or door frame, depending on which sensor provides the output indicating the detected object. In the event that the door is automatically moving when the sensor output is received, the controller 40 in one example stops the movement of the door to allow for the object to be removed before it is caught. In one example, the controller 40 causes the automated mover 42 to slowly move the door back and forth from a current position to allow for an object to become dislodged in the event that the object was caught before the door was stopped.

In the event that the door assembly corresponds to an elevator door assembly, the controller 40 takes into account information regarding movement of an elevator car. If an elevator car is in transit and approaching a landing where the door will be opened, the controller 40 responds to an output from one of the sensors 30, 32 or 34 indicating a detected object by providing an indication that an object should be moved away from the corresponding location. The controller 40 will then not allow the door to begin opening at the landing until the corresponding sensor indicates that the object has been removed (e.g., no longer provides an output indicating an object detected at the sensitive portion). If the controller 40 determines that an elevator car is in transit and is not near a landing where the elevator car will stop, the controller 40 may at least temporarily ignore an output from one of the sensors regarding contact between an object and one of the sensitive portions. In general, the controller 40 controls automatic movement of the door panel responsive to an output from at least one of the sensors 30, 32 or 34.

Figure 2:
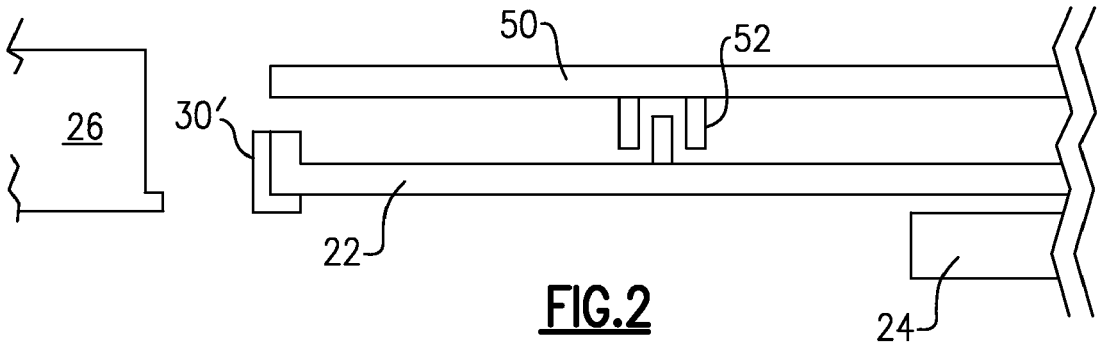
FIG. 2 schematically illustrates one example sensor placement.

There are a variety of ways for implementing a sensor arrangement designed according to an embodiment of this invention. FIG. 2 shows one example arrangement where a sensor 30' is provided only near a leading edge of the door panel 22. In the illustrated example, the door panel 22 is an elevator car door that is coupled with a hoistway door 50 by a known coupling arrangement 52 so that the doors move in unison. In the event that an object contacts or comes very near the sensitive portion associated with the sensor 30', the controller 40 can control the door movement as described above. It may be possible to add another sensor on the hoistway door 50, depending on the needs of a particular situation. The example of FIG. 2 is particularly useful for preventing an object from being caught when the doors 22 and 50 are moving toward a fully closed position.

Figure 3:
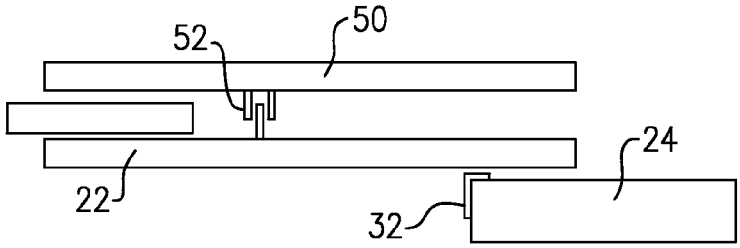
FIG. 3 schematically illustrates another sensor placement.

FIG. 3 schematically illustrates another example arrangement where the sensor 32 is provided on an edge of the return panel 24 where an object could potentially become caught between the door panel 22 and the return panel 24. During an opening movement, the door panel 22 will move to the right (according to the drawing). During such movement, it is possible for an object to become caught between the door panel 22 and the return panel 24. The sensor 32 in this example provides a sensitive portion for detecting the presence of such an object in the vicinity of the interface between the panels where such an object may become caught.

Figure 4:
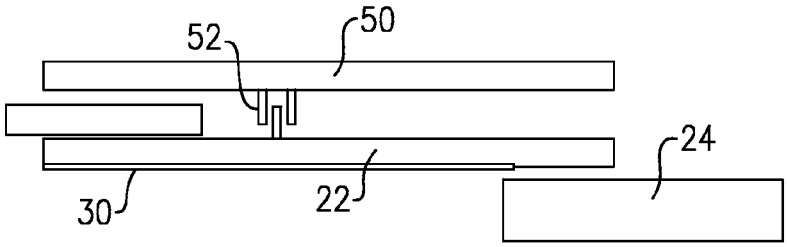
FIG. 4 schematically illustrates another example sensor placement.

FIG. 4 schematically shows an arrangement where the sensor 30 extends across a substantial portion of the door panel 22 to provide detection of an object at various locations where the object may be caught during an opening or a closing movement. In this example, the sensor 30 establishes a sensitive portion for detecting an object in a variety of locations where it may be caught during such movement. The leading edge of the door panel 22 has a sensitive portion established by the sensor 30 for detecting when an object is in a position where it may be caught as the door panel 22 moves to a fully closed position. The example of FIG. 4 shows how one sensitive portion on the door panel 22 can span a significant portion of the door panel to provide object detection that is useful during various automated movements of the door panel 22.

As mentioned above, the sensors used in the illustrated examples may have different forms. A known EMFi may be used for providing a pressure-responsive sensitive zone on a door panel or door frame member. EMFi films are known and provide an electrical output in a known manner. The controller 40 in one example is programmed to receive and interpret an EMFi output indicating the presence of an object at the corresponding sensitive portion.

Figure 5:
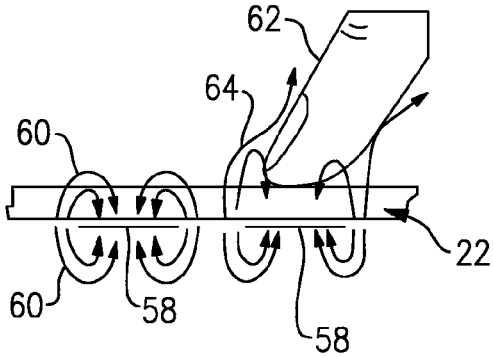
FIG. 5 schematically illustrates one type of sensor useful in an embodiment of this invention.

FIG. 5 schematically illustrates an example field effect sensor arrangement including a dielectric substrate 56 supported on the door panel 22. A plurality of touch cells 58 are supported on the door panel 22, also. The touch cells 58 and the dielectric substrate 56 cooperate to establish an electric field in a known manner along the sensitive portion as schematically shown at 60. When an object 62, such as an individual's finger, contacts or comes very close to the sensitive portion on the door panel 22, at least a portion of the electric field 60 is interrupted as schematically shown at 64. The sensor 30 provides an output indicating when the electric field is at least partially interrupted in this manner. In some examples, it is not necessary for an object to actually contact the sensitive portion of the door panel 22. In some examples, as long as an object is in very close proximity to the dielectric substrate 56, for example, that will be sufficient to interrupt the electric field 60 sufficiently to cause an output from the sensor indicating the presence of the object.

Figure 6:
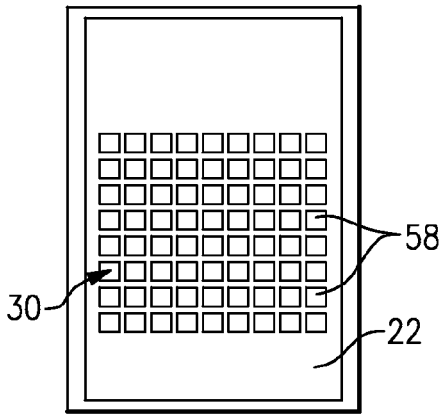
FIG. 6 schematically illustrates an example arrangement of the type of sensor shown in FIG. 5 for establishing a sensitive portion on a door panel.

A variety of sensor configurations may be used to establish a sensitive portion consistent with this invention. A sensor of the type schematically shown in FIG. 5 typically includes touch cells 58 on the order of 25 square millimeters to 900 square millimeters. Where a larger sensitive portion is desired, a plurality of touch cells 58 may be arranged as schematically shown in FIG. 6 to establish a correspondingly dimensioned sensitive portion on the door panel 22. In the example of FIG. 6, the sensor 30 comprises the plurality of touch cells 58 and an associated dielectric substrate supported on the door panel 22 for establishing the desired size and location of the sensitive portion on that panel.

Figure 7:
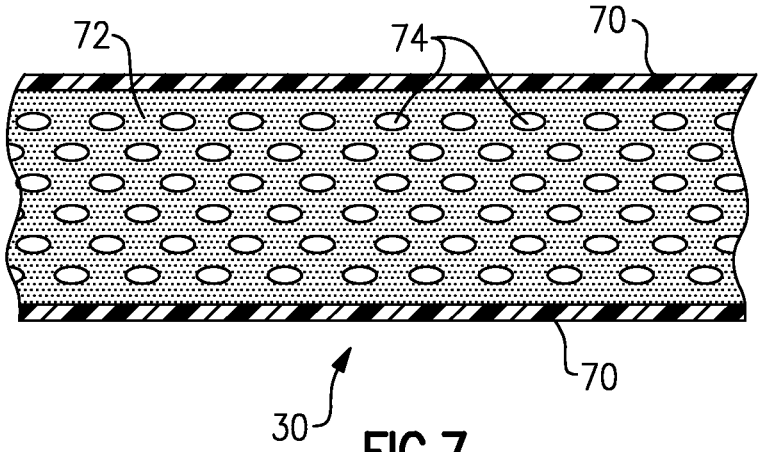
FIG. 7 schematically shows another example sensor arrangement useful in an embodiment of this invention.

FIG. 7 schematically shows another example sensor arrangement for the sensor 30. In this example, the sensor 30 comprises an electromechanical film (EMFi) having an electroconductive film 70 bonded to a material sheet 72. In this example, the material sheet 72 comprises polypropylene having a thickness of about 30 micrometers. The material sheet 72 includes a plurality of cavities 74 having an average diameter of 1 micrometer. Within each cavity 74, electrical charge is retained. In another example, the electroconductive film 70 comprises an electroconductive paste screen-printed onto the surface of a polyethylene film, which is the material 72 in such an example.

Figure 8:
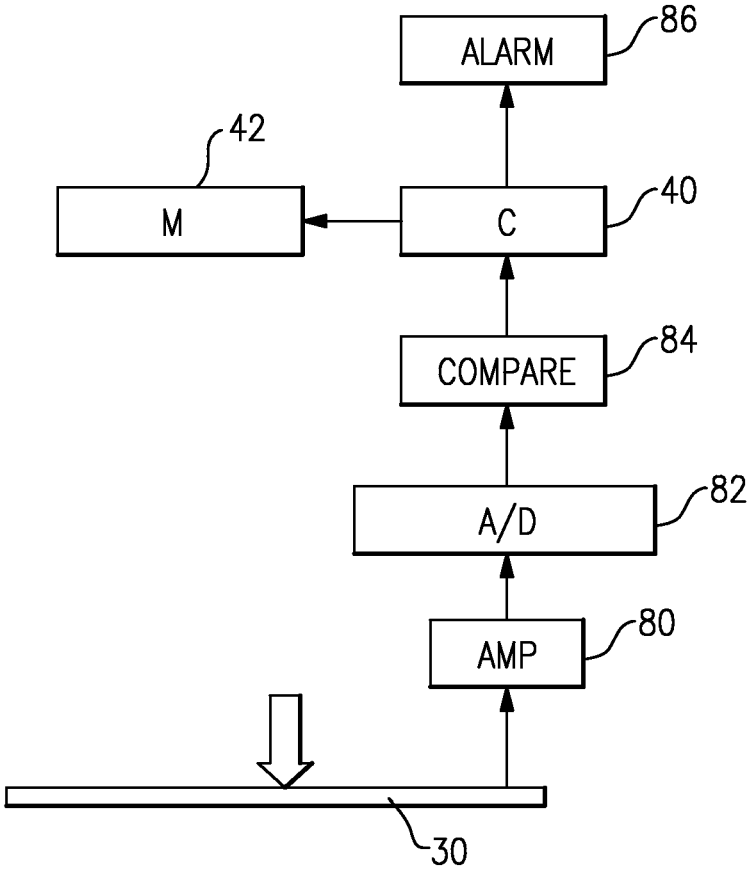
FIG. 8 schematically illustrates an arrangement of electronics useful within an embodiment of this invention.

FIG. 8 schematically shows one example arrangement of electronics for use with any one of the example sensors 30. In FIG. 8, an amplifier 80 amplifies an output signal (e.g., a voltage or current) from the sensor 30. An analog-to-digital converter 82 converts an analog signal from the amplifier 80 into a digital signal. A comparator 84 compares the digital signal to a threshold that is indicative of sufficient interaction between an object and the sensor 30 corresponding to a potential for an object being caught during door movement. The controller 40 receives a signal from the comparator 84 in this example whenever the comparator determines that the signal from the sensor 30 meets the threshold requirement. The controller 40 then responsively controls the door mover 42.

In the case of an EMFi sensor 30, a potential difference is generated on the electroconductive film 70 proportional to pressure applied by an object. That potential difference results in an analog signal such as a voltage that becomes amplified by the amplifier 80, converted by the analog-to-digital converter 82 and compared by the comparator 84 to an appropriate threshold. Given this description, those skilled in the art will realize what threshold level is useful for their particular situation based, in part, on the sensor design and the door assembly configuration.

In some situations, the object detection will occur under circumstances where it is useful to provide an alarm or indication that the object should be moved away from its current location. The example of FIG. 8 includes an alarm device 86 for providing such an indication. In one example, a visible indication is provided. In another example, an audible indication is provided. Of course, a combined visible and audible indication may be provided to alert an individual to move the object away from the location where it may become caught.

Figure 9:
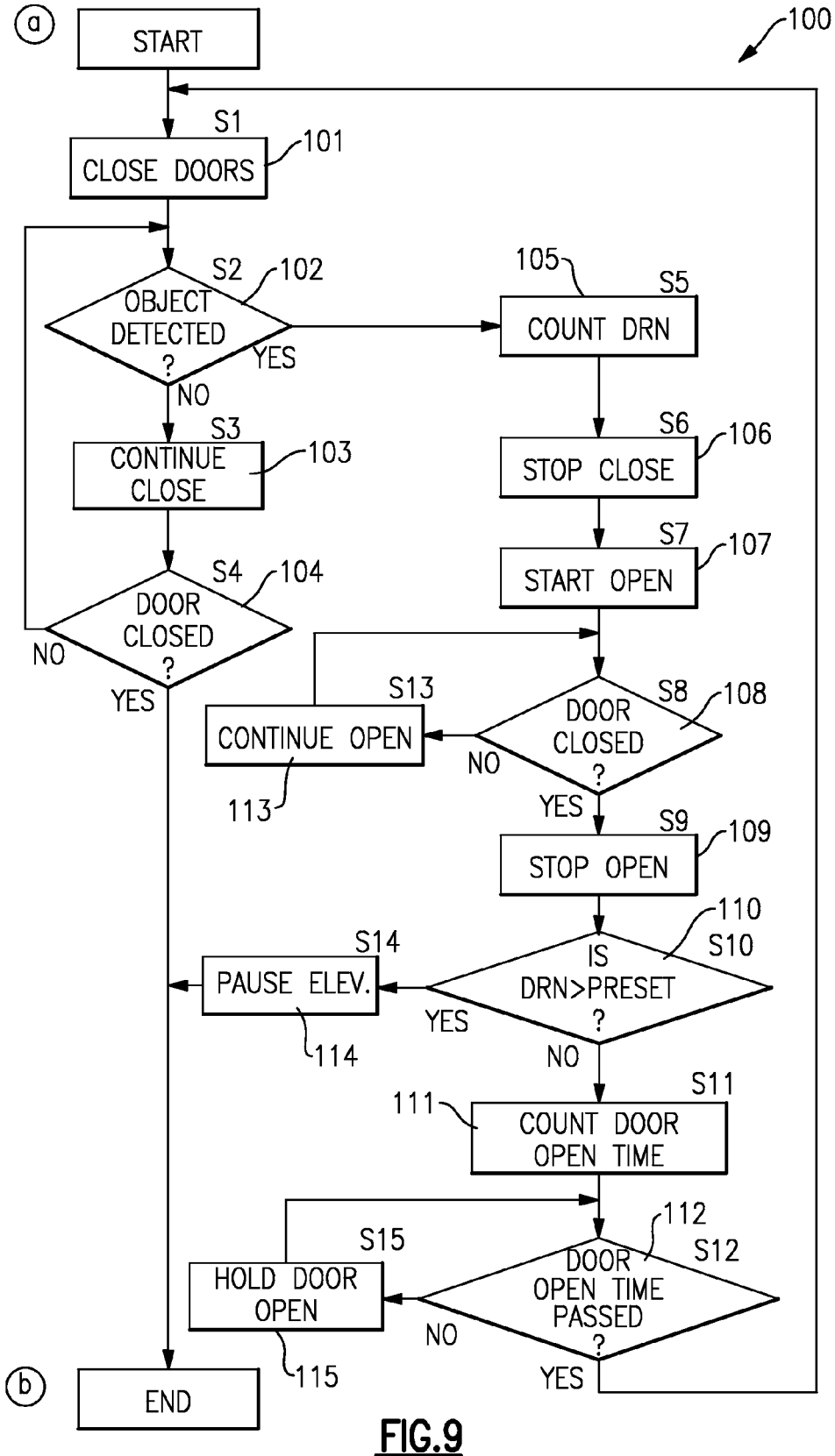
FIG. 9 is a flowchart diagram summarizing one example control approach.

Referring to FIG. 9, an example control strategy is shown at 100. This particular control strategy is useful for a controlling elevator door movement. While an elevator car is at a landing, a door closing operation commences at 101. During the door closing operation, a determination is made at 102 whether or not an object is detected. In the example of FIG. 2, this detection includes determining whether an object is near the sensor 30', for example. If not, the door closing operation continues at 103 and a determination is made at 104 whether the door has been fully closed. If an object is detected at 102, the controller 40 receives a detection signal and counts the number of detection rounds having the foreign object detection signal. At 106, the closing operation is stopped. The door begins opening at 107. A determination is made at 108 whether the doors is fully opened. If so, the opening operation stops at 109. The detection round number is compared to a preset detection round number at 110. If the current detection round number is not greater than the preset number, a door open time is counted at 111 and the door is kept open for a prescribed door opening time, which is monitored at 112. When the appropriate time has passed, the next door closing operation can commence at 101.

Assuming that the door was not fully opened at 108, the opening operation continues at 113. In the event that the detection round number is greater than the preset number at 110 and if the door movement operation has been performed repeatedly with a round number over a prescribed detection round number, the elevator will be paused at 114.

Also in the example of FIG. 8, the door is held open at 115 until sufficient door open time has passed at 112.

Figure 10:
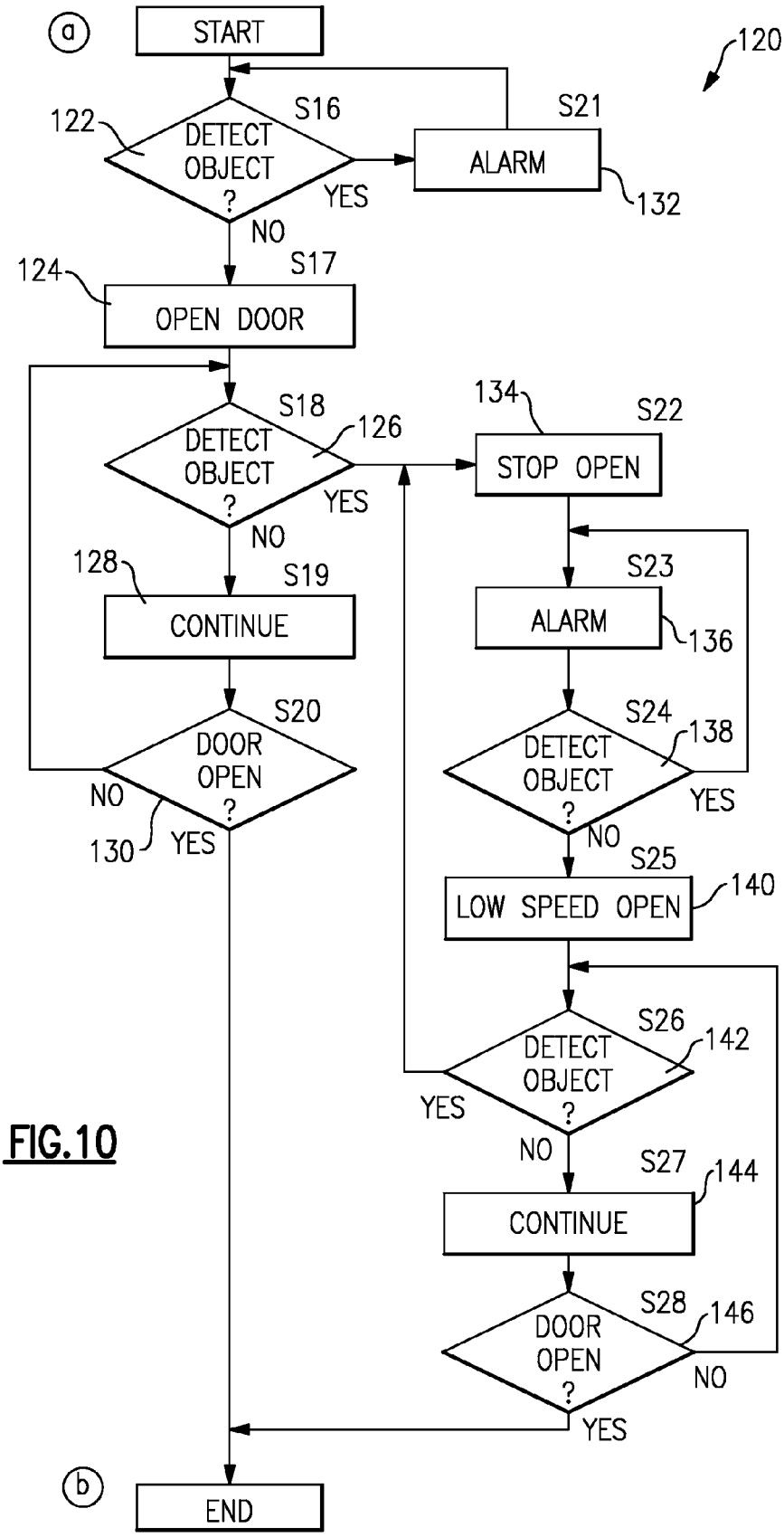
FIG. 10 is a flowchart diagram summarizing another example control approach.

Another example control technique is summarized in the flowchart 120 of FIG. 10. In this example a determination is made at 122 whether an object is detected by a sensor in a position relative to a door where the object may get caught if a door opening operation begins. When no sensor provides an indication of such an object, the door opening operation begins at 124. During the door opening operation, a determination is made at 126 whether any object is detected in a location where it may become caught. If the inquiry at 126 is negative, the door opening operation continues at 128 until the door is fully opened, which is checked at 130.

In the event that an object is detected at 126, the opening operation is stopped at 134. In this example, an alarm indication is provided at 136 indicating that the object should be moved from its location relative to the door. A determination is made at 138 whether the object has been moved. In this example, the alarm (e.g., visible or audible indication) is continuously provided until the sensor indicates that the object has been removed.

At 140, the opening operation continues but with a lower speed and lower torque. During this continued opening procedure, a determination is made at 142 whether an object is detected by one or more sensors. If not, the door opening operation continues at 144. At 146, a determination is made whether the door has been completely opened. If not, the door opening operation continues with continued monitoring for an object.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. A door assembly, comprising:

a door panel that is automatically moveable relative to a door frame between open and closed positions;

a sensor comprising an electromechanical film supported on at least one of the door frame or the door panel for establishing a sensitive portion on the at least one of the door frame or the door panel, the sensor detecting an object within a proximity of the sensitive portion responsive to one of a pressure applied by the object on the sensitive portion or contact between the object and the sensitive portion, the sensor providing an output indicative of the detected object; and a controller that controls automatic movement of the door panel responsive to the sensor output.

2. The assembly of claim 1, wherein the sensor has a dimension that defines a sensitive area that establishes a dimension of the sensitive portion.

3. The assembly of claim 1, wherein the sensor produces an electrical voltage responsive to the pressure, the voltage having a magnitude indicative of a magnitude of the pressure.

4. The assembly of claim 1, wherein the sensor generates an electric field and detects when the object is close enough to the sensitive portion to at least partially interrupt the electric field, the sensor providing the output responsive to the object at least partially interrupting the electric field.

5. The assembly of claim 4, wherein the sensor comprises at least one cell for generating the electric field and a dielectric substrate on at least one side of the cell facing toward the object.

6. The assembly of claim 5, comprising a plurality of the cells arranged to provide a sensing area over the entire sensitive portion.

7. The assembly of claim 1, wherein the controller determines if the door panel is moving between open and closed positions when the sensor provides the output and the controller provides a warning that the object should be moved away from the sensitive portion prior to initiating automatic door movement; or stops the door from moving for a predetermined amount of time or until the sensor output changes.

8. The assembly of claim 1, wherein the sensitive portion includes an edge of the door panel.

9. The assembly of claim 1, wherein the sensitive portion includes a planar surface oriented parallel to a direction of the door panel movement as the door panel automatically moves.

10. A method of controlling automatic door movement, comprising:

establishing a sensitive portion on at least one of a door panel or an associated door frame member by positioning an electromechanical film on the at least one of the door panel or the associated door frame member;

determining when an object is within a proximity of the sensitive portion by at least one of determining when the object contacts the sensitive portion or determining when the object applies pressure to the sensitive portion; and controlling automatic movement of the door when the object is within the proximity of the sensitive portion.

11. The method of claim 10, comprising establishing an electric field at the sensitive portion; and determining when the object is close enough to the sensitive portion to at least partially interrupt the electric field.

12. The method of claim 10, comprising establishing the sensitive portion on a generally planar surface of the door that is oriented parallel to a direction of movement of the door between open and closed positions.

13. The method of claim 10, comprising providing an indication that the object should be moved away from the sensitive portion when the object is in the proximity of the sensitive portion and the door is stationary; and automatically stopping movement of the door at least for a predetermined amount of time responsive to the object being in the proximity of the sensitive portion during door movement.

14. A door assembly, comprising:

a door panel that is automatically movable relative to a door frame between open and closed positions;

a sensor comprising an electromechanical film supported on at least one of the door frame or the door panel, wherein, the sensor substantially covers the at least one of the door frame or the door panel, the sensor is configured to detect an object within a proximity of the at least one of the door frame or the door panel; and the sensor is configured to provide an output when an object is detected; and a controller to control automatic movement of the door panel responsive to the sensor output.

15. The assembly of claim 14, wherein the controller determines if the door panel is moving between open and closed positions when the sensor provides the output and the controller provides a warning that the object should be moved away from the sensor prior to initiating automatic door movement; or stops the door from moving for a predetermined amount of time or until the sensor output changes.

16. The assembly of claim 14, wherein the sensor at least partially covers at least one edge of the door panel.

17. The assembly of claim 14, wherein the sensor is supported on at least one planar surface oriented parallel to a direction of the door panel movement as the door panel automatically moves.

18. The assembly of claim 14, wherein the sensor detects the object responsive to a pressure applied by the object on the sensor.

19. The assembly of claim 14, wherein the sensor generates an electric field and detects when the object is close enough to the sensor to at least partially interrupt the electric field, the sensor providing the output responsive to the object at least partially interrupting the electric field.

20. The assembly of claim 14, wherein the sensor provides the output responsive to contact between the object and the sensor.

* * * * *